US009644812B2

(12) United States Patent
Sun et al.

(10) Patent No.: US 9,644,812 B2
(45) Date of Patent: May 9, 2017

(54) HIGH-CONTRAST MINIATURE HEADLAMP

(71) Applicant: National Central University, Jhongli, Taoyuan County (TW)

(72) Inventors: Ching-Cherng Sun, Jhongli (TW); Chih-Yu Tsai, Jhongli (TW)

(73) Assignee: National Central University, Taoyuan (TW)

( * ) Notice: Subject to any disclaimer, the term of this patent is extended or adjusted under 35 U.S.C. 154(b) by 0 days.

(21) Appl. No.: 14/538,972

(22) Filed: Nov. 12, 2014

(65) Prior Publication Data

US 2016/0102829 A1 Apr. 14, 2016

(30) Foreign Application Priority Data

Oct. 14, 2014 (TW) ..... 103135566 A

(51) Int. Cl.
*F21S 8/10* (2006.01)

(52) U.S. Cl.
CPC ..... *F21S 48/1388* (2013.01); *F21S 48/1159* (2013.01); *F21S 48/1329* (2013.01)

(58) Field of Classification Search
CPC ..... A61B 2019/262; F21S 48/1159; F21S 48/1329; F21S 48/1388
See application file for complete search history.

(56) References Cited

U.S. PATENT DOCUMENTS

2006/0126353 A1* 6/2006 Ishida ..... F21S 48/1159 362/543
2006/0285316 A1* 12/2006 Tufenkjian ..... F21V 21/084 362/105
2012/0327678 A1* 12/2012 Koike ..... B60Q 1/085 362/520

* cited by examiner

*Primary Examiner* — Joseph L Williams
*Assistant Examiner* — Jacob R Stern
(74) *Attorney, Agent, or Firm* — Juan Carlos A. Marquez; Marquez IP Law Office, PLLC

(57) ABSTRACT

A high-contrast miniature headlamp includes at least one light-emitting element, a first reflective surface, and a second reflective surface. The high-contrast miniature headlamp forms a virtual equivalent light source of the light-emitting element via the first reflective surface to increase the equivalent distance between the light source and the second reflective surface, thereby enhancing the contrast of the cutoff line of the beam pattern produced by the headlamp. The headlamp is so configured that, under the condition of maintaining its miniature design and reducing cost without compromising optical efficiency, a beam pattern with a high-contrast cutoff line (i.e., a high-contrast beam pattern) can be generated to significantly improve the safety provided by automobile lighting.

8 Claims, 5 Drawing Sheets

HIGH-CONTRAST MINIATURE HEADLAMP

BACKGROUND OF THE INVENTION

1. Technical Field

The present invention relates to a high-contrast miniature headlamp and, more particularly, to a high-contrast miniature headlamp which can reflect the light of the light source for a second time to increase the length of the optical path, thereby producing a clear cutoff line between the illuminated area and the non-illuminated area.

2. Description of Related Art

With the modernization of society, our demands for transportation means, such as cars, are increasing, and more and more importance is attached to car lamps as their functions are directly linked to the personal safety of car drivers and other road users.

Recently, therefore, improvements and innovative inventions on car lamps or car lamp structures that are intended for better beam patterns are drawing much attention. The mainstream technique, however, still lies in lens improvement, which increases the contrast of a beam pattern only slightly and is disadvantaged by low optical efficiency and bulkiness in design.

Another well-known technique is to increase the area used for reflecting the light of the light source. While this approach can enhance optical efficiency to some degree, a car lamp thus designed cannot generate a clear cutoff line without occupying a large volume, which increases the cost of implementation and reduces the willingness of use.

In view of the above, it has been the hope of car users and the car industry alike to sec the creation of a practical, high-contrast miniature headlamp whose optical design enables a clear cutoff line to be formed not only despite the small volume of the lamp, but also without lowering optical efficiency, so as to significantly increase the safety provided by automobile lighting.

BRIEF SUMMARY OF THE INVENTION

The present invention discloses a high-contrast miniature headlamp including at least one light-emitting element, a first reflective surface, and a second reflective surface. By implementing the present invention, a headlamp can produce a clear cutoff line between the illuminated area and the non-illuminated area (i.e., a high-contrast beam pattern) without having to increase the physical volume of the lamp while featuring cost reduction but no reduction in optical efficiency. The goal is to significantly increase the safety provided by automobile lighting.

According to one aspect of the present invention, a high-contrast miniature headlamp includes at least one light-emitting element, a first reflective surface, and a second reflective surface. The light-emitting element is provided on one side of the first reflective surface so that the first reflective surface can reflect the light projected thereon by the light-emitting element while the light-emitting element forms a virtual equivalent light source on the other side of the first reflective surface. The second reflective surface is fixedly provided adjacent to the light-emitting element but is not directly exposed to the light projected by the light-emitting element. The second reflective surface reflects the light of the light-emitting element that is reflected by the first reflective surface, and light reflected from the second reflective surface propagates outward through an outgoing surface.

According to another aspect of the present invention, a high-contrast miniature headlamp includes at least one light-emitting element and a light-permeable member fixedly provided adjacent to, and directly exposed to the light projected by, the light-emitting element. The light-permeable member includes a first reflective surface and a second reflective surface. The light-emitting element is provided on one side of the first reflective surface in order for the first reflective surface to reflect the light projected thereon by the light-emitting element, and for the light-emitting element to form a virtual equivalent light source on the other side of the first reflective surface. The second reflective surface is fixedly provided adjacent to, but is not directly exposed to the light projected by, the light-emitting element. The second reflective surface reflects the light of the light-emitting element that is reflected by the first reflective surface, and light reflected from the second reflective surface propagates outward through an outgoing surface.

Implementation of the present invention at least provides the following advantageous effects;

1. The costs of headlamps can be lowered while the miniature headlamp design is retained. In addition, the lighting functions of headlamps can be enhanced without compromising optical efficiency.

2. The same headlamp structure can produce a high beam and a low beam, and the length of the optical path is increased by secondary reflection.

3. A headlamp can output a beam pattern with a clear cutoff line between the illuminated area and the non-illuminated area to substantially increase the safety provided by automobile lighting.

The features and advantages of the present invention are detailed hereinafter with reference to the preferred embodiments. The detailed description is intended to enable a person skilled in the art to gain insight into the technical contents disclosed herein and implement the present invention accordingly. In particular, a person skilled in the art can easily understand the objects and advantages of the present invention by referring to the disclosure of the specification, the claims, and the accompanying drawings.

BRIEF DESCRIPTION OF THE SEVERAL VIEWS OF THE DRAWINGS

The invention as well as a preferred mode of use, further objectives and advantages thereof will be best understood by reference to the following detailed description of illustrative embodiments when read in conjunction with the accompanying drawings, wherein.

DETAILED DESCRIPTION OF THE INVENTION

Figure 1:
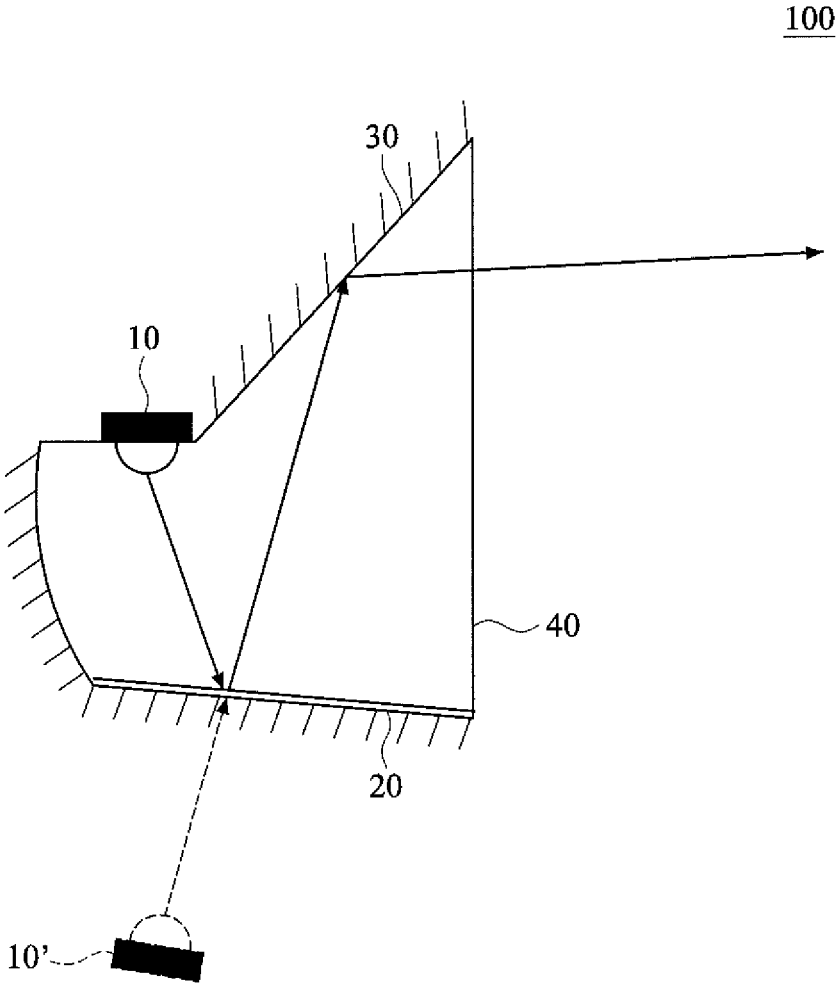
FIG. 1 is a schematic sectional view of the high-contrast miniature headlamp in an embodiment of the present invention.

Referring to FIG. 1, the high-contrast miniature headlamp 100 in an embodiment of the present invention includes at least one light-emitting element 10, a first reflective surface 20, and a second reflective surface 30. The light-emitting element 10 is fixedly provided at one side of the interior of the high-contrast miniature headlamp 100.

Figure 2:
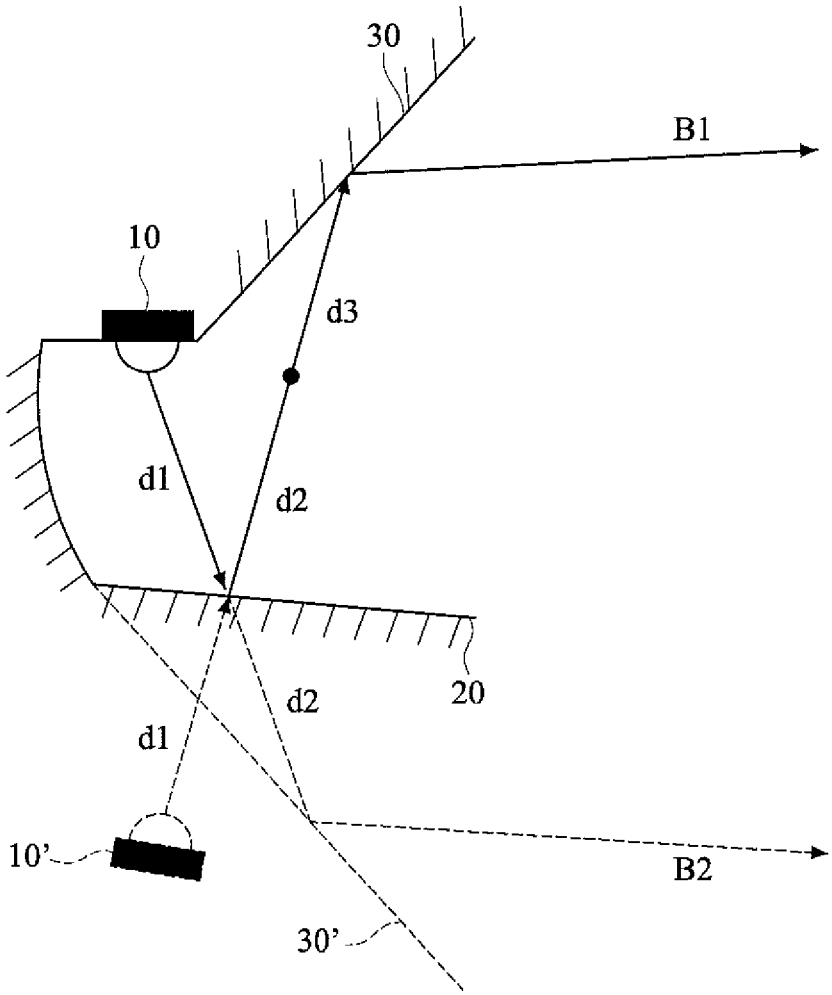
FIG. 2 schematically shows how light travels in the high-contrast miniature headlamp in an embodiment of the present invention.

As shown in FIG. 1 and FIG. 2, the light-emitting element 10 is fixedly provided at one side of the interior of the high-contrast miniature headlamp 100. The light-emitting element 10 can be a light-emitting diode (LED) module, wherein the LED module includes at least one LED or at least one organic LED (OLED).

Referring again to FIG. 1 and FIG. 2, the high-contrast miniature headlamp 100 has one first reflective surface 20, and the light-emitting element 10 is provided on one side of the first reflective surface 20. The first reflective surface 20 serves to reflect the light projected thereon by the light-emitting element 10 while the light-emitting element 10 forms a virtual equivalent light source 10' on the other side of the first reflective surface 20. The first reflective surface 20 can be a flat mirror, a convex mirror, or a concave mirror.

With continued reference to FIG. 1 and FIG. 2, the second reflective surface 30 of the high-contrast miniature headlamp 100 is fixedly provided adjacent to the light-emitting element 10 but is not directly exposed to the light projected by the light-emitting element 10. The second reflective surface 30 serves to reflect the light of the light-emitting element 10 that is reflected by the first reflective surface 20, and light reflected from the second reflective surface 30 propagates outward through an outgoing surface 40.

Reference is now made to FIG. 2, in which a single light-emitting element 10 is shown by way of example. In the absence of the first reflective surface 20, light emitted from the light-emitting element 10 directly impinges on and is reflected by a third reflective surface 30' such that an outgoing light beam B2 is produced. The length of the optical path traveled within the headlamp by the light emitted from the light-emitting element 10 is the sum of the lengths of the optical path sections d1 and d2.

In the presence of the first reflective surface 20, however, light emitted from the light-emitting element 10 strikes the first reflective surface 20 while the light-emitting element 10 forms an equivalent light source 10' on the other side of the first reflective surface 20. More specifically, light emitted from the light-emitting element 10 is reflected by the first reflective surface 20, cast onto the second reflective surface 30, and then reflected by the second reflective surface 30 to produce an outgoing light beam B1. The length of the optical path traveled within the headlamp by the light emitted from the light-emitting element 10 is the sum of the lengths of the optical path sections d1, d2, and d3.

In this embodiment, both the first reflective surface 20 and the second reflective surface 30 reflect the light emitted from the light-emitting element 10. Therefore, the high-contrast miniature headlamp 100 is a headlamp structure capable of secondary reflection.

In the high-contrast miniature headlamp 100, the optical path traveled by the light emitted from the light-emitting element 10 is extended ($d1+d2+d3>d1+d2$) in comparison with if the first reflective surface 20 is absent. This extension of the optical path is equivalent to placing the light-emitting element 10 at a farther location from the second reflective surface 30, with a view to effectively modulating the output beam pattern of the high-contrast miniature headlamp 100. As a result, the contrast of the cutoff line of the beam pattern output from the high-contrast miniature headlamp 100 is enhanced.

Figure 3:
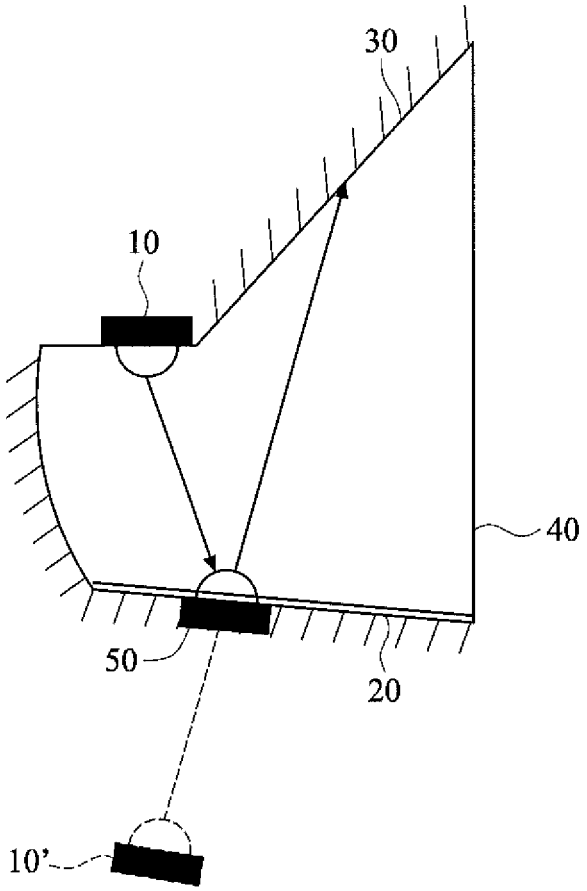
FIG. 3 is a schematic sectional view showing the high-contrast miniature headlamp of FIG. 1 further equipped with a light-emitting component.

Moreover, referring to FIG. 3, the first reflective surface 20 of the high-contrast miniature headlamp 100 can be further provided with a light-emitting component 50, wherein the light-emitting component 50 is located at the intersection between the first reflective surface 20 and the optical path from the virtual equivalent light source 10' to the second reflective surface 30. The light-emitting component 50 can be at least one LED or at least one OLED.

Thus, the high-contrast miniature headlamp 100 has two light sources (i.e., the light-emitting element 10 and the light-emitting component 50) inside. When the light-emitting element 10 and the light-emitting component 50 are a low-beam light source and a high-beam light source respectively, the high-contrast miniature headlamp 100 can provide both low-beam and high-beam illumination with a high-contrast beam pattern.

Figure 4:
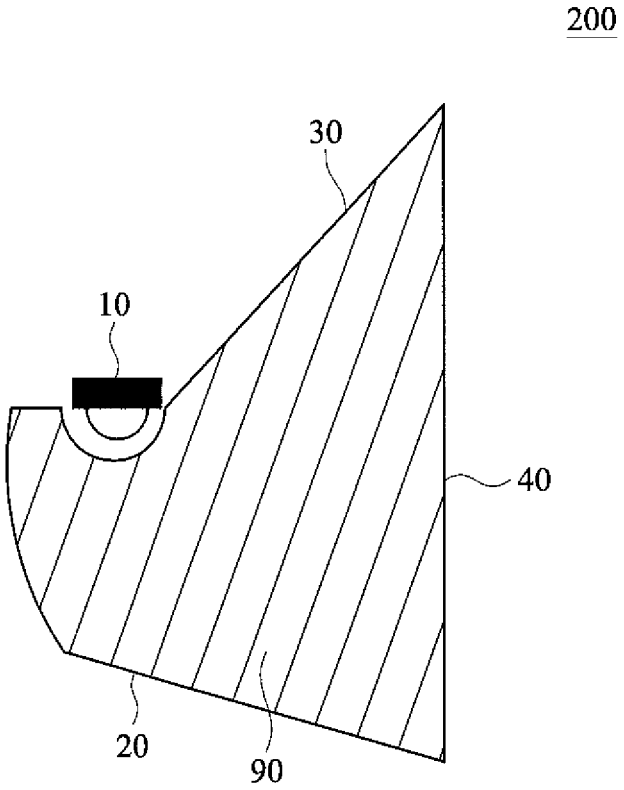
FIG. 4 is a schematic sectional view of the high-contrast miniature headlamp in another embodiment of the present invention.

FIG. 4 shows another embodiment of the present invention, in which the high-contrast miniature headlamp 200 includes at least one light-emitting element 10 and a light-permeable member 90.

The light-emitting element 10 of the high-contrast miniature headlamp 200 is fixedly provided at one side of the light-permeable member 90, allowing the light emitted from the light-emitting element 10 to enter the light-permeable member 90. The light-emitting element 10 of the high-contrast miniature headlamp 200 can also be an LED module, wherein the LED module includes at least one LED or at least one OLED.

As shown in FIG. 4, the light-permeable member 90 is fixedly provided adjacent to the light-emitting element 10, is directly exposed to the light projected by the light-emitting element 10, and includes a first reflective surface 20 and a second reflective surface 30. The light-permeable member 90 can be made of glass, sapphire, ceramic, etc. If necessary, the material of the light-permeable member 90 should be so selected that its transmittance matches the intended application.

Figure 5:
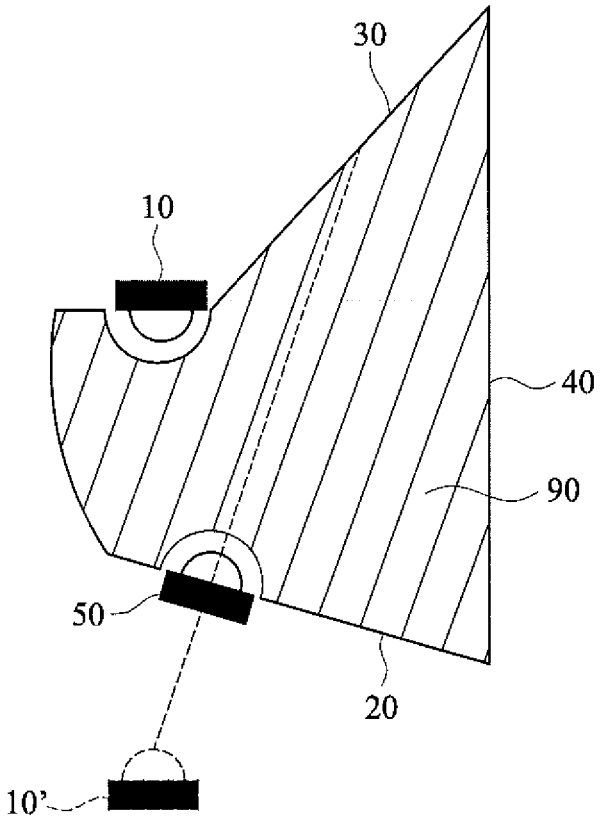
FIG. 5 is a schematic sectional view showing the high-contrast miniature headlamp of FIG. 4 further equipped with a light-emitting component.

As shown in FIG. 4 and FIG. 5, the light-emitting element 10 of the high-contrast miniature headlamp 200 is provided on one side of the first reflective surface 20. The first reflective surface 20 serves to reflect the light projected thereon by the light-emitting element 10 while the light-emitting element 10 forms a virtual equivalent light source 10' on the other side of the first reflective surface 20. The first reflective surface 20 can be a flat reflective surface, a convex reflective surface, or a concave reflective surface.

With continued reference to FIG. 4 and FIG. 5, the second reflective surface 30 is fixedly provided adjacent to the light-emitting element 10 but is not directly exposed to the light projected by the light-emitting element 10. The second reflective surface 30 serves to reflect the light of the light-emitting element 10 that is reflected by the first reflective surface 20, and light reflected from the second reflective surface 30 propagates outward through an outgoing surface 40.

In the high-contrast miniature headlamp 200, the first reflective surface 20 extends the optical path traveled by the light emitted from the light-emitting element 10, and this extension of the optical path is equivalent to placing the light-emitting element 10 at a farther location from the second reflective surface 30, with a view to effectively modulating the output beam pattern of the high-contrast miniature headlamp 200. As a result, the contrast of the cutoff line of the beam pattern output from the high-contrast miniature headlamp 200 is enhanced.

Moreover, referring to FIG. 5, the first reflective surface 20 can be further provided with a light-emitting component 50, wherein the light-emitting component 50 is located at the intersection between the first reflective surface 20 and the optical path from the virtual equivalent light source 10' to the second reflective surface 30. Likewise, the light-emitting component 50 can be at least one LED or at least one OLED.

Thus, the high-contrast miniature headlamp 200 has two light sources (i.e., the light-emitting element 10 and the light-emitting component 50) inside. When the light-emitting element 10 and the light-emitting component 50 are a low-beam light source and a high-beam light source respectively, the high-contrast miniature headlamp 200 can provide both low-beam and high-beam illumination with a high-contrast beam pattern.

The embodiments described above are intended only to demonstrate the technical concept and features of the present invention so as to enable a person skilled in the art to understand and implement the contents disclosed herein. It is understood that the disclosed embodiments are not to limit the scope of the present invention. Therefore, all equivalent changes or modifications based on the concept of the present invention should be encompassed by the appended claims.

What is claimed is:

1. A high-contrast miniature headlamp, comprising:

at least one light-emitting element;

a first reflective surface on a side of which the light-emitting element is provided in order for the first reflective surface to reflect light projected thereon by the light-emitting element, and for the light-emitting element to form a virtual equivalent light source on an opposite side of the first reflective surface; and a second reflective surface fixedly provided adjacent to the light-emitting element but not in direct exposure to light projected by the light-emitting element, the second reflective surface reflecting light which is projected by the light-emitting element and reflected by the first reflective surface such that light reflected from the second reflective surface propagates outward through an outgoing surface;

wherein the first reflective surface is further provided with a light-emitting component, and the light-emitting component is mounted into the first reflective surface and located at an intersection between the first reflective surface and an optical path from the virtual equivalent light source to the second reflective surface.

2. The high-contrast miniature headlamp of claim 1, wherein the first reflective surface is a flat, convex, or concave mirror.

3. The high-contrast miniature headlamp of claim 1, wherein the light-emitting element is a light-emitting diode (LED) module and includes at least one LED or at least one organic LED (OLED).

4. The high-contrast miniature headlamp of claim 3, wherein the first reflective surface is a flat, convex, or concave mirror.

5. A high-contrast miniature headlamp, comprising:

at least one light-emitting element; and a light-permeable member fixedly provided adjacent to the light-emitting element and in direct exposure to light projected by the light-emitting element, the light-permeable member comprising:

a first reflective surface on a side of which the light-emitting element is provided in order for the first reflective surface to reflect light projected thereon by the light-emitting element, and for the light-emitting element to form a virtual equivalent light source on an opposite side of the first reflective surface; and a second reflective surface fixedly provided adjacent to the light-emitting element but not in direct exposure to the light projected by the light-emitting element, the second reflective surface reflecting light which is projected by the light-emitting element and reflected by the first reflective surface such that light reflected from the second reflective surface propagates outward through an outgoing surface;

wherein the first reflective surface is further provided with a light-emitting component, and the light-emitting component is mounted into the first reflective surface and located at an intersection between the first reflective surface and an optical path from the virtual equivalent light source to the second reflective surface.

6. The high-contrast miniature headlamp of claim 5, wherein the first reflective surface is a flat, convex, or concave reflective surface.

7. The high-contrast miniature headlamp of claim 5, wherein the light-emitting element is a light-emitting diode (LED) module and includes at least one LED or at least one organic LED (OLED).

8. The high-contrast miniature headlamp of claim 7, wherein the first reflective surface is a flat, convex, or concave reflective surface.

* * * * *